United States Patent [19]

Fink, Jr.

[11] Patent Number: 4,658,987

[45] Date of Patent: Apr. 21, 1987

[54] NO PRESSURE SHUT OFF FOR AUTOMATIC FUEL NOZZLE VALVE

[75] Inventor: Arthur C. Fink, Jr., Franklin County, Mo.

[73] Assignee: Husky Corporation, Pacific, Mo.

[21] Appl. No.: 774,014

[22] Filed: Sep. 9, 1985

[51] Int. Cl.[4] ..... B61D 5/34

[52] U.S. Cl. ..... 222/52; 222/56; 222/153; 222/511; 141/302; 141/392; 137/509

[58] Field of Search ..... 222/52, 56, 472–474, 222/505, 511, 153, 335; 141/206, 208, 209, 217, 218, 302, 392; 137/509

[56] References Cited

U.S. PATENT DOCUMENTS

| | | | |
|---|---|---|---|
| 3,005,476 | 10/1961 | Klaus | 222/52 |
| 3,042,083 | 7/1962 | Kruckeberg | 141/208 |
| 3,077,212 | 2/1963 | Hearn | 222/52 |
| 3,088,500 | 5/1963 | Payne | 137/797 X |
| 3,502,121 | 3/1970 | Moore et al. | 141/209 X |
| 3,651,837 | 3/1972 | Murray | 137/599.2 X |
| 3,817,285 | 6/1974 | Wilder et al. | 141/206 X |
| 4,331,187 | 5/1982 | Trygg | 141/218 |
| 4,343,336 | 8/1982 | Trygg | 222/52 |
| 4,450,879 | 5/1984 | Wood | 141/209 |
| 4,453,578 | 6/1984 | Wilder | 141/209 |
| 4,572,255 | 2/1986 | Rabinovich | 141/217 |

FOREIGN PATENT DOCUMENTS

| | | | |
|---|---|---|---|
| 0055031 | 6/1982 | European Pat. Off. | 222/52 |
| 2134883 | 8/1984 | United Kingdom | 141/206 |

*Primary Examiner*—Joseph J. Rolla
*Assistant Examiner*—Edward S. Ammeen
*Attorney, Agent, or Firm*—Paul M. Denk

[57] ABSTRACT

This invention adds a fuel pressure sensitive piston at a location adjacent to the automatic shut off mechanism of a fuel dispensing nozzle. A lever responsive to the reciprocal movements of the piston biases against the diaphragm of the shut off mechanism raising it and disengaging its associated latch mechanism for release of the dispenser handle and closure of the nozzle poppet valve when there is no fuel being delivered from the pump. When there is fuel pressure from the pump at the inlet of the nozzle, the piston is forced in an opposite direction releasing its contact through a lever with said diaphragm and allowing the automatic shut off mechanism to routinely function.

5 Claims, 3 Drawing Figures

NO PRESSURE SHUT OFF FOR AUTOMATIC FUEL NOZZLE VALVE

BACKGROUND OF THE INVENTION

This invention relates generally to the provision of a control means for initiating disengagement of the diaphragm and its latch mechanism for a fuel dispensing nozzle incorporating an automatic shut off means that curtails the further delivery of fuel when the vehicle's gasoline tank approaches a fill.

There are a variety of control mechanisms incorporated into fuel dispensing nozzles, and generally for providing a finer regulation in the actual dispensing of fuel to a vehicle, and to shut the same off when a fuel tank has either attained a fill, or to provide for shut off of the nozzle when its associated dispenser ceases to deliver any further quantity of gasoline or other fuel. For example, the U.S. Pats. to Trygg, No. 4,331,187, and No. 4,343,336, disclose liquid dispensing devices, which further incorporate means operatively associated with their disclosed main valves, and which provide for shut off of their associated nozzles through manipulation of their diaphragm means particularly when their pump is deactivated after completion of a dispensing function, so that when the pump is once again activated, they avoid the risk of unexpected flow of gasoline through the nozzle before it is inserted into a vehicle. While the concept of the Trygg device is related to the subject matter of this current invention, the current invention yet operates sufficiently distinctly, and likewise incorporates entirely different structure, for achieving related results.

Other patents disclose means for providing automatic shut-off of the dispensing nozzle responsive to the amount of liquid reaching the tank, such as shown in the Wilder U.S. Pat. No. 4,453,578. In addition, the Hearn U.S. Pat. No. 3,077,212, discloses another form of automatic shut-off device for a gasoline dispensing nozzle. The Klaus U.S. Pat. shows an automatic safety nozzle, No. 3,005,476.

Additional patents having some relation to automatic closing of nozzle structures are shown in the Payne U.S. Pat. No. 3,088,500, the Murray U.S. Pat. No. 3,651,837, the Moore U.S. Pat. No. 3,502,121, the Kruckeberg U.S. Pat. No. 3,042,083, the Wilder U.S. Pat. No. 3,817,285, in addition to the United Kingdom published patent application Ser. No. 8,033,735.

It is submitted, upon review of these prior art patents, that the current inventidn, as previously explained, affords different structure for producing, in most instances, differing results, or perhaps better results, than the nozzle structures shown and described in these variety of prior patents and disclosures.

SUMMARY OF THE INVENTION

Among the several objects and features of this invention are the provision of a minimum of operating components in the form of a piston and lever mechanism that deactivate, or shut off, a fuel dispensing nozzle when the dispenser or pump has ceased the delivery of gasoline to the same.

This invention contemplates the addition of components to the standard fuel dispensing nozzle, particularly that nozzle which is used for the self service delivery of gasoline to the vehicle, in order to minimize, if not eliminate, the mishaps that frequently occur which can be hazardous to the station and its customers when the gasoline dispensing nozzle is improperly used by the unskilled. For example, and which has occurred, particularly in self-service delivery of gasoline, in the filling of the vehicle gasoline tank, short of a complete fill up, through the purchase of a select dollar amount of fuel, sometimes the nozzle will remain open, even after the dispenser has shut down, upon attainment of that purchased amount of gasoline, only to have the opened nozzle once again reinserted back into the pump by the customer. Hence, what frequently occurs is that when the next customer enters the station and desires to purchase a quantity of gasoline, particularly to a specified amount, when the dispenser is once again turned on or reset by the proprietor, and the customer begins to locate the nozzle from the pump to the vehicle, gasoline will begin to flow at the moment the dispenser is turned on. This is a highly undesireable situation, and the occurrence can lead towards the flow of gasoline around the station, the customer, and could certainly, and on occasion has led to a fire and explosion, particularly where a cigarette or other igniting means is within the approximate area. Hence, the need for a remedy to this situation is essential.

The current invention utilizes the standard fuel dispensing nozzle, incorporating a flow housing, having fuel inlet and outlets, a valve seat for the main poppet, an automatic shut off means when the fuel tank approaches a fill, in addition to a handle for controlling these operations. In addition, this current invention incorporate& a small chamber angularly oriented with respect to the diaphragm and support means of the automatic shut off means, having a piston reciprocally mounted therein, and which is sensitive to either a spring provided at one end of the piston, or the pressure of fluid received from the inlet of the nozzle by way of a flow passage, and which is delivered to the opposite end of the identified piston. Thus, the reciprocation of this piston within its chamber, provides the means for deactivation of the nozzle's automatic shut-off means, so that the nozzle will close when the identified spring forces its piston to the opposite end of its chamber, such as when fuel under pressure from the dispenser ceases to flow. On the other hand, when the dispenser is turned on, and the nozzle may be closed that time, the fuel pressure forces the piston against the bias of its chamber arranged spring, thereby disengaging this control means from contact with the diaphragm, or its support, to allow it to operate in its usual and normal fashion. Further structure incorporated into this development includes the provision of a slot within the identified piston, and the arrangement of one end of a pivotally mounted lever within said slot, so that the lever can be pivoted for movement in conjunction with the reciprocal shifting of the piston within its chamber. The other end of the lever incorporates a camming surface, and which is designed for biasing against the diaphragm or its support means for raising it to achieve disengagement of the normally operating automatic shut-off means for the dispensing nozzle, or in the alternative, when the piston is shifted in an opposite direction, said camming means disengages from the diaphragm to allow the automatic shut-off means to function normally, and without interference, all as previously explained.

It is, therefore, the principal object of this invention to provide control means for automatically shutting off a dispensing nozzle when fuel pressure from the dispenser and within the inlet of the nozzle decreases due to dispenser shut off.

Another object of this invention, is to provide a rolling diaphragm means hermetically sealing and operating in conjunction with a piston, sensitive to the nozzle inlet fuel pressure, to provide normal operation of the nozzle for dispensing fuel, but effecting a shut-off of the nozzle means, and closure of its poppet valve, when pressure at the inlet of the nozzle decreases below a certain level or drops to zero. This decrease below a certain level depends upon the strength and bias of the spring acting against the reciprocating piston employed in conjunction with the control means.

Still another object of this invention is to provide piston means which shifts its lever means into a nonoperating position when fuel under pressure is routinely being dispensed through a fuel dispensing nozzle.

These and other objects will become more apparent to those skilled in the art upon reviewing the description of the preferred embodiment, when viewed together with the drawings.

DESCRIPTION OF THE PREFERRED EMBODIMENT

Figure 1:
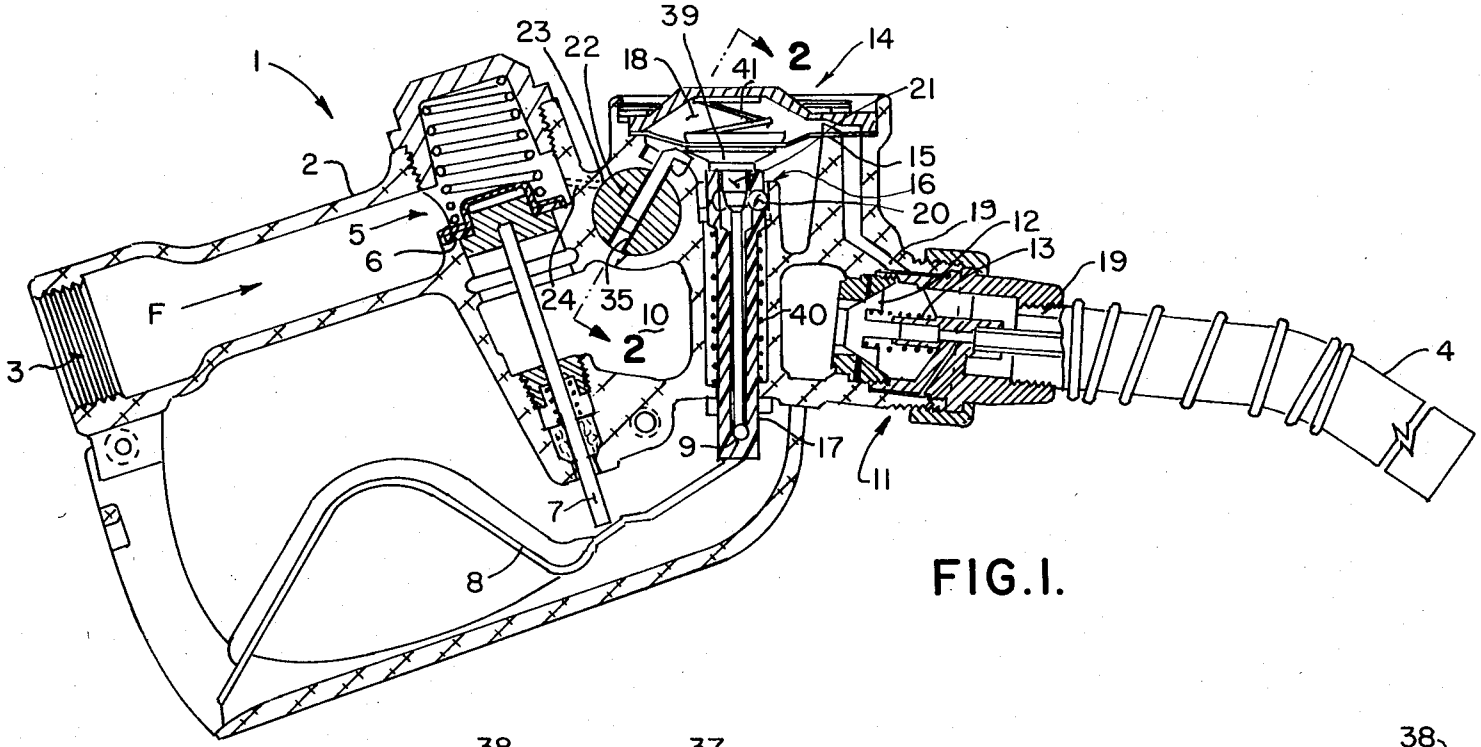
FIG. 1 is a longitudinal sectional view of a dispensing nozzle disclosing the automatic shut-off control means of this invention.

In referring to the drawing, an automatic shut-off fuel dispensing nozzle of the present invention is shown in its entirety at 1. The nozzle is disclosed as having a housing 2 generally of cast aluminum, or other suitable material, and incorporating a fluid flow passage F therethrough. The flow passage incorporates an inlet 3 and an outlet spout 4. It should be appreciated that the inlet 3 is provided with internal threads so that the dispensing nozzle may be threadedly connected onto the dispensing hose, or the like, which in turn connects with the fuel pump or dispenser (not shown). As is generally known, the poppet valve assembly, as generally indicated at 5, is disposed within the housing 2, and is cooperable with a valve seat 6 within the flow passage for movement between a closed position, in which the poppet valve blocks the flow of fuel through the dispensing nozzle, as shown in the drawing, or an open raised position (not shown), in which the poppet valve member is clear of valve seat 6, so as to permit the flow of fuel from the inlet 3 and to the outlet or spout 4. Thus, the poppet valve 5 constitutes a control valve for the nozzle. An axially moveable stem 7 is provided which extends exteriorly of the housing 2, and this stem is engageable by a handle 8 pivotally attached to the dispensing nozzle, as indicated at 9, so as to permit the selected dispensing of fuel at various flow rates, depending on the distance the poppet valve 5 is displaced from its seat 6. These are well known structures in the art.

Housing 2 further includes a so-called main body cavity, as indicated generally at 10, downstream from the valve seat 6, and into which the fuel flows upon passing through said poppet valve assembly. The fuel exits the main body cavity into a venturi arrangement, as generally indicated at 11, before it enters the upper end of the outlet spout 4. A normally closed check valve 12 is provided within the venturi, and the check valve is biased towards its closed position by means of the shown spring 13. This normally closed check valve prevents the leaking of fuel from the body cavity 10 upon the closing of the poppet valve 5. It will be appreciated that upon opening of the poppet valve, fuel pressure within the main body cavity 10 forces the check valve open against the bias of its spring and permits the normal flow of fuel to be dispensed from the nozzle spout 4.

As is conventional, means, as generally indicated at 14, is provided for automatically terminating the flow of fuel from the dispensing nozzle 1, in the event that the container or fuel tank into which the fuel is being dispensed becomes filled up to the level of the lower end of its dispensing spout 4. This automatic shut-off means includes a diaphragm actuator, as indicated at 15, which effects the release of the plunger carrying fulcrum or latch mechanism, as at 16, releasing the mechanism 17 about the pivot point 9 of the nozzle handle, thereby returning the poppet valve assembly 5 to its normally closed position under the bias of its disclosed spring, and thereby blocking the flow of fuel through the nozzle.

More particularly, a so-called atmospheric pressure chamber 18 is provided within the housing 2 on one side of the diaphragm actuator 15, and this atmospheric chamber is in communication with the atmosphere by means of a series of passageways within the housing 2 which in turn are in communication with a vent tube, part of it as shown at 19, that extends substantially lengthwise of the spout or outlet 4 to a vent port proximate the outer end of said spout. As is standard in the art, a plurality of detent balls 20 cooperate with a moveable tapered pin 21 which in turn is carried by the latch mechanism or plunger 17, the lower end of the latch mechanism having the handle 8 pivotally attached thereto by the fulcrum pin 9. Normally, the diaphragm chamber 18 is vented to the atmosphere by the vent tube and passages 19. As long as this vent tube is open (i.e., uncovered by fuel on the outside of the spout 4), the vacuum in the chamber 18 will be broken and diaphragm actuator 15 will maintain the detent balls 20 in their position as shown in FIG. 1, permitting the stem 7 to be moved axially inwardly of the housing 2 upon the user moving of it the nozzle handle 8 towards said housing. However, if the fuel level in the fuel tank of the vehicle rises so as to generally cover the end of the spout 4, or its vent tube 19, air will be prevented from entering the said vent tube, and the vacuum within the chamber 18 will cause the diaphragm actuator 15 to raise the pin 21 which in turn will release the detent balls 20. When this occurs, the latch mechanism or plunger 17 will move outwardly moving its pivot pin 9 which in turn releases the stem 7 and permits the poppet valve assembly 5 of the present invention to be automatically returned to its closed position thereby blocking the flow of any further fuel through the dispensing nozzle. Generally, the construction and operation of the automatic shut-off features of this particular valve and nozzle are well known by those skilled in the art.

Figure 2:
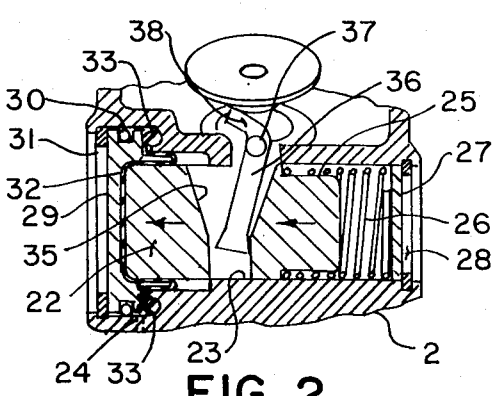
FIG. 2 provides a sectional view of the control means of this invention taken along the line 2—2 of FIG. 1.
Figure 3:
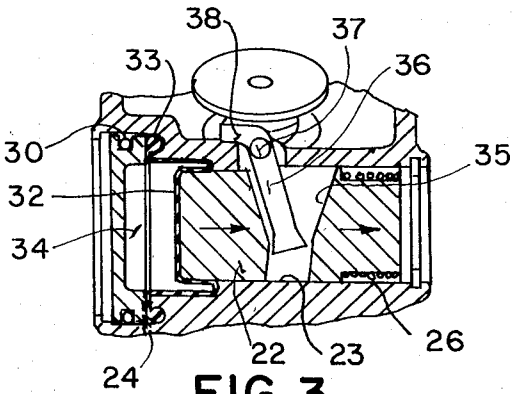
FIG. 3 shows a view of the control means of this invention, also taken along the line 2—2 of FIG. 1, but in this instance the piston has been shifted for disengagement of the control means as during normal pressurized fuel flow from the dispenser and through its associated nozzle.

The essence of this invention comprises the means for furnishing an automatic shut off of the poppet valve, through further manipulation of the automatic shut-off means 14 of the nozzle, as when fuel pressure particularly at the inlet end 3 of the nozzle drops below a certain level, or attains a no pressure status. More specifically, this invention includes the provision of a piston 22 within a piston chamber 23 formed within and angularly arranged through the nozzle housing 2. More specifically, this particular piston and its chamber are laterally disposed, and generally perpendicularly arranged with respect to the diaphragm mechanism 15. There is a flow passage 24 leading from the upstream side of the poppet valve assembly 5, and it enters into one end, that left end of the piston cylinder shown in FIG. 2, in order that fuel under pressure when entering the inlet port 3 of the nozzle is received from the pumper dispenser, the fuel attains access to one side of the piston 22 within its chamber 23, as noted. In addition, the piston at its other end is of reduced diameter, as at 25, and seats thereon a spring 26 that normally urges the piston from this end of the chamber to its other end, as can be noted. The piston cylinder is closed at its spring located end by means of a cap 27 held in place by means of an expansion retainer ring 28, as noted. At its other end, the piston chamber is closed and sealed in position by means of the location of a sealing cap 29, hermetically sealed therein through the arrangement of an 0-ring 30 held in position by means of another retaining ring 31. Another diaphragm means, as at 32, is sealed into position upon the proximate end of the piston 22, with the enlarged perimeter, as at 33, of the diaphragm being held in position by means of the sealing cap 29, pressing it against the formed shoulder of the piston chamber. This diaphragm, generally identified as a rolling type diaphragm, generally conforms and seats upon the proximate end of the piston 22, as can be seen, and has a tendency to shift with the piston, as it moves to the right, as shown in FIG. 3, such as when fuel under pressure enters into the proximate end of the piston chamber, as at 34, which occurs when fuel under pressure passes through the flow passage 24 from the inlet end of the nozzle, as previously identified. Thus, as can be readily determined, the piston 22 is disposed for reciprocal movement within its chamber 23, and is normally biased to the left, as shown in FIG. 2, through the agency of the spring 26, but that when fuel under pressure is received from the pump at the nozzle inlet 3, the same pressurized fuel enters into the other end of the formed chamber, as at 34, urging the piston 22 with its rolling diaphragm 32 to move to the right, as can be seen in FIG. 3, against the bias of its associated spring 26.

In addition to the foregoing, it can be seen that the piston 22 has a slot 35 formed therein. One end of a lever 36 is arranged for locating within the piston slot, while the lever is also pivotally mounted to the nozzle housing, by means of the pin 37. The upper end of the lever 36 is formed into a camming surface 38, and this camming surface is designed for contacting the diaphragm support 39, that normally is secured with the central portion of the formed diaphragm 15 of the automatic shut-off mechanism.

In view of the foregoing structural description, the functioning and purpose for this particular control mechanism becomes readily apparent. When the fuel pump or dispenser has been shut off, then there is no fuel under pressure located within the nozzle inlet 3. Thus, there is no fuel pressure passing through the flow passage 24, which means that no pressure is acting upon the left side of the piston 22, nor its rolling diaphragm 32. Thus, the piston undertakes the position as shown in FIG. 2, under the bias of its spring 26, causing its lever 36 to be shifted with the piston, forcing its upper camming edge or surface 38 to bias against the support means 39 of the diaphragm 15. When this occurs, the diaphragm is physically raised, causing the diaphragm stem 21 to be raised, allowing the detent balls 20 to move inwardly, providing clearance for the latch mechanism 17 to drop, or descend, allowing the handle 8 to lower, in addition to the poppet stem 7, causing the poppet valve assembly 5 to close upon its valve seat 6. Thus, when the dispenser has been shut off, the nozzle likewise will enter into closure. Hence, under that condition, should the dispenser once again be turned on, the nozzle will not allow the passage of fuel therethrough. The closed poppet valve will prevent such.

On the other hand, when the dispenser or pump is once again opened, for the delivery of fuel under pressure to its nozzle, the fuel enters into the inlet port 3, along the flow passage F, and some fuel under pressure passes above the closed poppet valve assembly 5, through the passage 24, and into the end 34 of the piston chamber, forcing the piston to move to the right, as shown in FIG. 3, in addition to its rolling diaphragm 32, which seals the fluid therein, with the piston being urged against its associated spring 26. As this occurs, as can be seen, the lever 36 is moved to the right, as noted, pivots about its pin 37, and its camming edge 38 disengages from contact with the undersurface of the support means 39 of the diaphragm 15. When this occurs, the latch mechanism 17 is urged upwardly by means of its pressure spring 40, while at the same time the diaphragm 15 under the exertion of its spring 41 is urged downwardly, thereby forcing the detent balls 20 to once again be moved outwardly, by means of the tapered bottom end of the diaphragm stem 21, through their associated apertures provided within the upper end of the plunger or latch mechanism 17, to retain the latch into its upward and locked position. As this happens, the handle 8 is once again free to be pressed upwardly, forcing its stem 7 upwardly, thereby opening the poppet valve assembly 5, unseating it from its valve seat 6, to allow fuel to normally flow through the housing 10, and to routinely allow the delivery of fuel out of the nozzle spout 4. Thus, the proper amount of gas may be once again conveniently dispensed either until the fuel tank becomes once again full, or until that prepaid amount of gasoline has been delivered.

In view of the foregoing, it can be readily seen that this particular control means of this invention is designed to operate effectively to shut off the operations of the fuel dispensing nozzle, particularly through the agency of its associated automatic shut-off mechanism operating in conjunction with the diaphragm means 14, particularly when fuel pressure drops when its associated pumper dispenser has been turned off.

Variations or modifications to the structure of this invention may occur to those skilled in the art upon reviewing the subject matter of this disclosure. Such modifications, if within the spirit of this invention, are intended to be encompassed within the scope of any claims to patent protection issuing upon this development. The description of the preferred embodiment set forth herein, and further in view of its drawing, are provided for illustrative purposes only.

I claim:

1. In a fuel nozzle attaching with a dispenser, said nozzle having a housing, the latter having a fuel flow passage therethrough from a fuel inlet to a fuel outlet, a valve seat within said housing constituting a part of said fuel flow passage between said inlet and said outlet, a poppet valve movable between a closed position in which it sealingly engages said valve seat to block the flow of fuel or into an open position thereby to permit the flow of fuel through said fuel flow passage, said poppet valve having a stem extending exteriorly of said housing, said nozzle further having a manually moveable handle pivotally supported relative to said housing for selectively engaging said stem and being moveable between an off position in which said handle is out of engagement with said stem and said poppet valve is in its closed position and an on position in which said handle is in engagement with said stem thereby to effect an opening movement of said poppet valve from its closed position, and said nozzle further including a vacuum operated latch mechanism pivotally connected at one end with the handle and disposed adjacent to a vacuum chamber at the other end and incorporating a diaphragm and a diaphragm support means for automatic shut-off of the dispensing nozzle when a vehicle fuel tank fills, the improvement which comprises, a piston angularly disposed with respect to the diaphragm and the support means and arranged for reciprocal movement within the nozzle housing, said housing having a formed chamber for disposition and movement of the piston therein, said piston and its chamber being transversally arranged within the nozzle and generally perpendicularly disposed with respect to the diaphragm and its support means, a spring provided within and at one end of the chamber engaging one end of the piston and normally biasing it to the other end of the chamber, there being a fuel passage provided between the other end of the chamber and the fuel inlet of the nozzle to conduct fuel under pressure to said other end of the chamber to force the piston against the bias of the spring towards the one end of the chamber when the dispenser is delivering fuel, and structural means operatively associated with the piston to effect a deactivation of the vacuum operated latch mechanism as the spring biased piston moves towards the other end of the chamber during dispenser shut-off, and said associated structural means provided for initiating reactivation of the latch mechanism during movement of said piston towards the one end of the chamber and against the bias of a spring as said dispenser initiates the flow of fuel under pressure.

2. The invention of claim 1 and wherein said structural means includes a lever, said lever being pivotally connected to the housing, said piston having a slot provided therein, said lever at one end partially extending into said piston slot, said lever at the other end forming a camming means, said camming means disposed for contacting the diaphragm support means, whereby the movement of said piston from the other end to the one end of and from the one end to the other end of the chamber respectively activates and deactivates the latch mechanism.

3. The invention of claim 2 and including another diaphragm provided within the other end of the piston chamber and disposed for movement during movement of the piston therein.

4. The invention of claim 3 and wherein said another diaphragm comprises a rolling diaphragm.

5. A piston means for initiating activation and deactivation; respectively of the operations of a vacuum operated diaphragm for a fuel dispensing nozzle, a latch mechanism operatively associated with said diaphragm, said diaphragm being of a type incorporating a support means and cooperating with the connecting latch mechanism for providing automatic shut off of the fuel dispensing nozzle, said nozzle having a chamber formed therein, said piston means disposed for reciprocal movement within said chamber, said piston means and chamber being transversally arranged within the nozzle, and structural means operatively associated with the piston means to effect initiation of the activation and deactivation respectively of the latch mechanism depending upon the movement of the piston means within the chamber, said structural means operatively associated with the piston means for effecting activation of the latch mechanism as the piston means moves towards one end of the chamber during nozzle shut-off and for effecting deactivation of the latch mechanism as the piston means moves towards the other end of the chamber as fuel flows through the dispensing nozzle.

* * * * *